United States Patent [19]

Veenendaal

[11] 4,206,332

[45] Jun. 3, 1980

[54] COAXIAL SWITCH

[75] Inventor: Cornelis T. Veenendaal, Portland, Oreg.

[73] Assignee: Tektronix, Inc., Beaverton, Oreg.

[21] Appl. No.: 794,783

[22] Filed: May 9, 1977

[51] Int. Cl.[2] ..... H01H 3/00

[52] U.S. Cl. ..... 200/153 S; 200/157; 200/252

[58] Field of Search ..... 200/153 S, 155 R, 165, 200/252, 305, 157, 153 N, 263, 279, 290

[56] References Cited

U.S. PATENT DOCUMENTS

| | | | |
|---|---|---|---|
| 408,194 | 7/1889 | Riggs | 200/155 R |
| 1,392,324 | 10/1921 | Graf | 200/155 R |
| 2,697,767 | 12/1954 | Charles | 200/153 S |
| 3,005,881 | 10/1961 | Ellsworth | 200/155 R |
| 3,371,167 | 2/1968 | Soulakis, Jr. | 200/155 R |

FOREIGN PATENT DOCUMENTS

| | | | |
|---|---|---|---|
| 683745 | 11/1939 | Fed. Rep. of Germany | 200/155 R |
| 684072 | 11/1939 | Fed. Rep. of Germany | 200/155 R |
| 325316 | 10/1957 | Switzerland | 200/155 R |

*Primary Examiner*—Joseph Man-Fu Moy
*Attorney, Agent, or Firm*—George T. Noe

[57] ABSTRACT

A coaxial switch comprising a metallic cylindrical body and cover assembly having a metallic rotor disposed therein includes transmission line portions having a uniform constant impedance characteristic over the lengths thereof. Both double pole, double throw and single pole, multiple throw switch configurations may be provided. The rotor may be driven either manually or electrically.

4 Claims, 5 Drawing Figures

COAXIAL SWITCH

BACKGROUND OF THE INVENTION

Coaxial switches of various design have been used for many years and are well known in the art. Such coaxial switches are useful in applications where extremely high frequency signals are to be coupled or routed from one transmission line to another. The major problems encountered in the design of coaxial switches have typically been to maintain a uniform impedance characteristic over the length of the transmission line through the switch, while at the same time maintaining good electrical contact. Abrupt changes in these characteristics cause signal reflections and changes in the voltage standing wave ratio, and these problems are compounded as the frequencies increase.

One coaxial switch capable of both double pole, double throw and single pole, multiple throw configurations is taught by U.S. Pat. No. 2,697,767. The center conductor of a transmission line is disposed in an open cavity in a rotor such that the matching face of the associated body forms a portion of the outer conductor. A plunger assembly inside the rotor bears on the center conductor to maintain good electrical contact. In other words, room is provided within a surrounding dielectric block to permit the center conductor to move under spring pressure. This arrangement results in unwanted reflections generated at the point where the plunger bears on the center conductor. In addition, the dielectric constants of the transmission line are uneven, resulting in a non-uniform and unpredictable impedance characteristic over the length of the transmission line.

SUMMARY OF THE INVENTION

The present invention relates to electrical switches and more particularly to coaxial switches for coupling high-frequency electrical signals from one transmission line to another.

A coaxial switch for high frequency applications, for example, in a spectrum analyzer where frequencies may be expected to exceed 40 GHz, comprises a metallic cylindrical body and cover assembly having a metallic rotor disposed therein. Such cover and rotor having matching planar faces transverse to the longitudinal axis of the cylindrical body. The rotor contains one or more U-shaped channels, each having a center conductor disposed therein to form a transmission line whose both ends terminate at the planar face. The center conductor is suspended in a uniform dielectric medium equidistant from the channel walls to ensure a constant impedance characteristic over the length of the transmission line. The cover has two or more bores therein to which coaxial transmission lines are connected. Spring-loaded contacts are provided at the ends of the center conductors of such transmission lines for electrical engagement with the ends of the center conductors in the rotor, thereby completing one or more electrical circuits through the switch. Cross talk between center conductors is minimized because the metallic cover and rotor parts are contiguous with the channel walls which serve as the outer conductor of the transmission lines.

The switching is accomplished by rotating the rotor. Both double pole, double throw and single pole, multiple throw switch configurations may be provided. The rotor may be driven either manually or by means of an electric motor. An electric motor facilitates remote operation as well as automatic operation.

It is therefore one object of the present invention to provide a coaxial switch having a constant impedance characteristic over transmission line portions thereof.

It is another object to provide an improved coaxial switch for extremely high frequency operation, wherein both double pole, double throw and single pole, multiple throw switch configurations may be provided.

It is a further object to provide an improved coaxial switch which may be operated either manually or automatically by remote control.

It is an additional object to provide an improved coaxial switch in which impedance is constant with frequency, and phase shift, crosstalk, and moding are eliminated.

Other objects and attainments of the present invention will become apparent to those skilled in the art upon a reading of the following detailed description when taken in conjunction with the drawings.

DETAILED DESCRIPTION OF THE INVENTION

Figure 1:
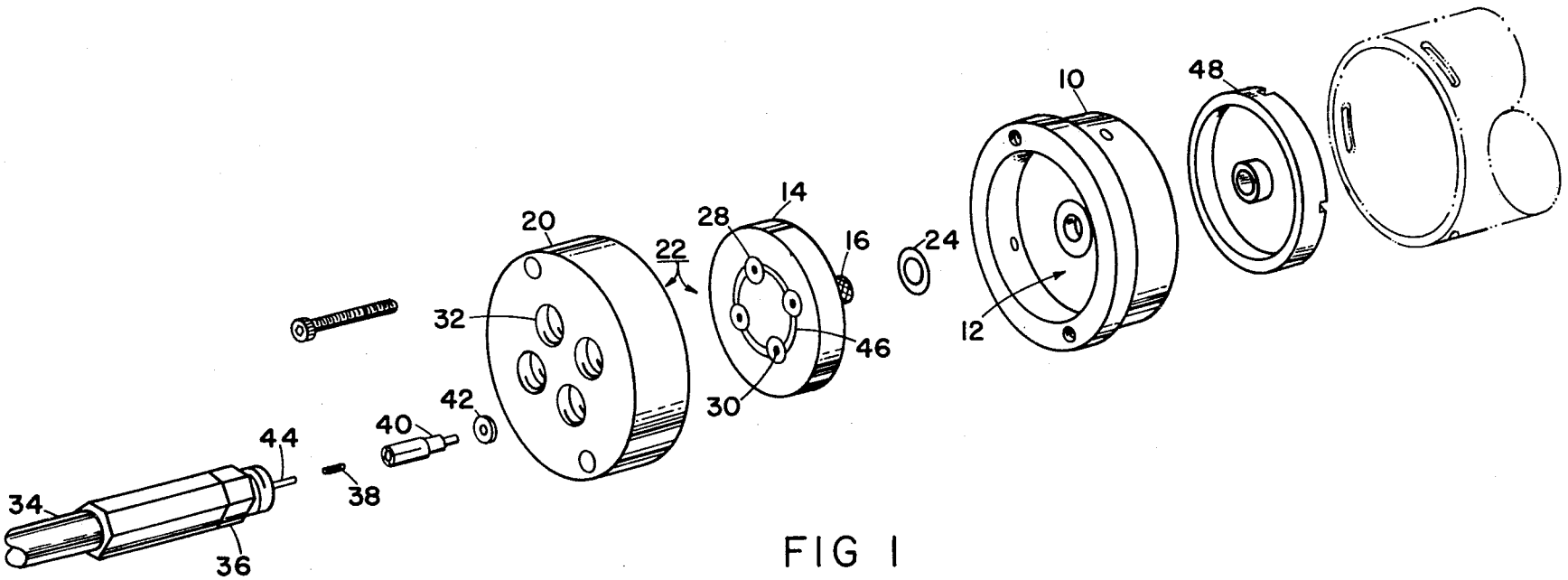
FIG. 1 is an exploded perspective view of a coaxial switch.

An exploded perspective view of a coaxial switch in accordance with the present invention is shown in FIG. 1. The particular configuration illustrated is a motor-driven double pole, double throw coaxial switch; however, as will be pointed out, the general switch construction is applicable to other configurations as well. A switch body 10 having the general form of a cylinder includes a cylindrical cavity or rotor socket 12 for receiving therein a rotatable rotor 14. The switch body 10 may be fabricated from any material, but is preferably metallic. The rotor 14 is fabricated from metal, and includes a shaft 16 which extends through a bushing 18 in the end wall of the body 10. A metallic cover 20 is secured to the body 10 to provide a complete housing for a switch assembly. Many fastening methods are available for attaching the cover 20 to the body 10; however, one expedient method is to utilize a pair of hex-socket machine screws (one shown). The cover 20, which forms an end wall of the aforementioned cylindrical housing, and rotor 14 have matching planar faces 22 which are transverse to the cylindrical axis and are urged into engagement with each other by a spring washer 24.

For the double pole, double throw configuration shown in FIG. 1, the rotor 14 contains two short transmission line segments whose four ends 28 terminate at the planar face 22. Two generally U-shaped channels form the outer conducting walls of the transmission lines, and center conductors 30 are provided therethrough. Such center conductors are suspended equidistant from the channel walls in a dielectric medium. The cover 20 has four bores 32 extending therethrough in alignment with the transmission line ends 28 in rotor 14. Conventional coaxial cables, such as type RG 55/U, having threaded connectors are threadedly engaged and secured into bores 32. While four such coaxial cables are necessary for the double-pole, double throw configuration, one coaxial cable 34 having a metallic threaded connector 36 is shown for simplicity. The connector 36 is electrically connected to an outer conductor, e.g., a braided wire "shield," so that the metallic cover 20, body 10, and rotor 14 are all at the same electrical potential when the assembly is complete. A spring-loaded contact assembly comprising a spring 38, contact member 40, and dielectric wafer 42 is provided for each coaxial cable to provide electrical contact between a center conductor 44 of coaxial cable 32 and center conductor 30 of the transmission line segments in rotor 14. Thus the spring-loaded contact assemblies located inside the bores 32 form short transmission line segments inside the cover 20. All of the transmission line segments within the body 10 and cover 20 have a uniform wall diameter over the length of such segments. An insulated track 46 suitably may be provided between the transmission line ends 28 on the face 22 of rotor 14 to insulate the contact 40 from the outer conductor portion of the transmission line between switch positions.

A knob may be attached to shaft 16 for rotating the switch, or a mechanism for providing automatic control may be attached to shaft 16. For example, a motorized intermittent drive with 90° indexing to provide a one-quarter turn of rotor 14 may be utilized. A knob-like indexing member 48 is pressed onto shaft 16 to provide the switch drive. A motorized mechanism, shown in phantom, suitably may be coupled to the switch assembly to provide a remote-controlled operation thereof. Such motorized mechanisms, which typically include a reduction gear drive offset from the central axis, are well known in the art. One such mechanism is known as a Geneva drive.

Figure 2:
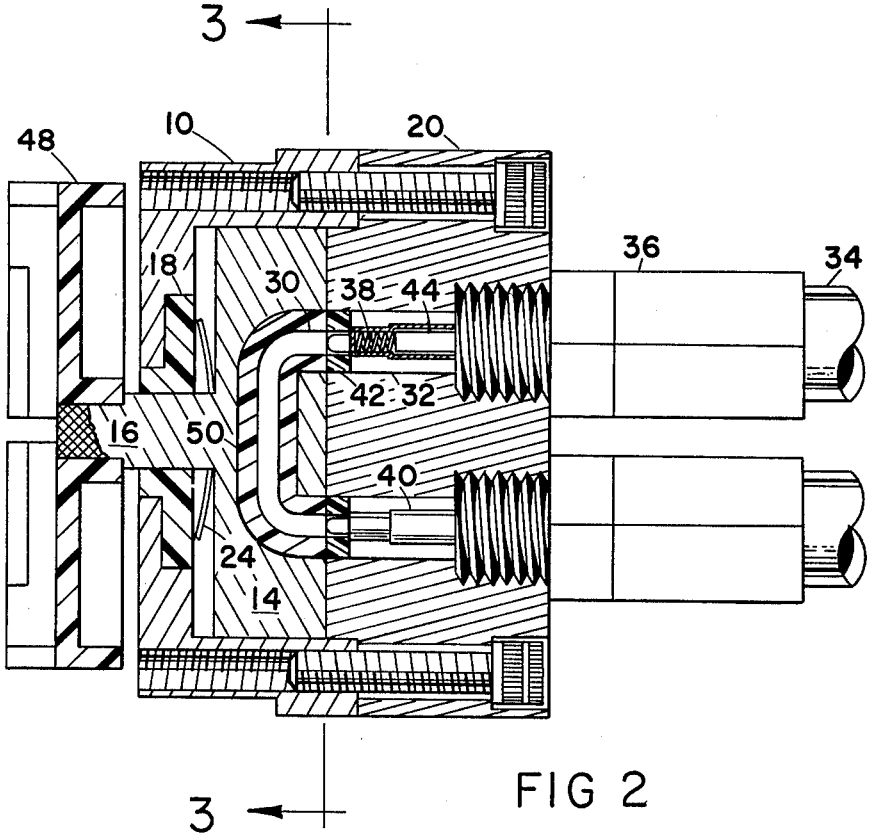
FIG. 2 is an elevational cross-sectional view of a double pole, double throw configuration of the coaxial switch.
Figure 3:
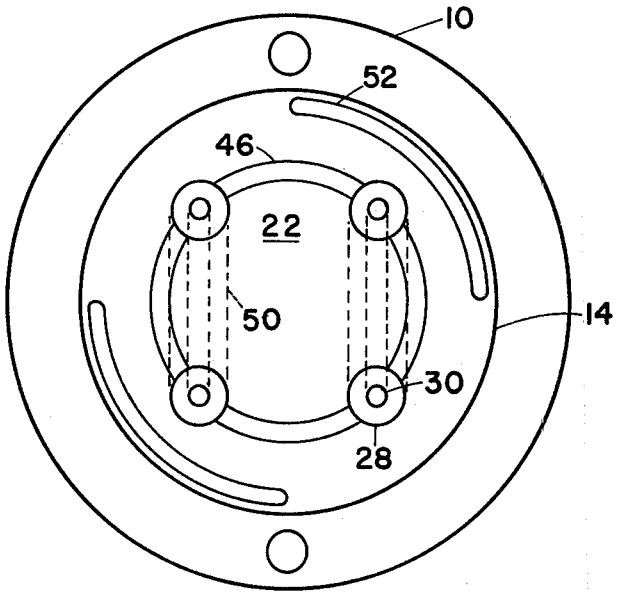
FIG. 3 is a cross-sectional view taken along the lines 3—3 of FIG. 2.

A double pole, double throw switch structure is shown in FIGS. 2 and 3, wherein elements corresponding to those described in conjunction with FIG. 1 are given like reference numerals. FIG. 2 illustrates an elevational cross section of the switch assembly, while FIG. 3 illustrates a section taken along the lines 3—3 of FIG. 2. The body 10 of the switch is assembled with cover 20 to provide a housing which remains stationary while a rotatable rotor 14 is disposed inside the switch to perform the switching operation. A shaft 16 extends through a bushing 18 in the switch body to which a knob or other operating member may be attached to operate the switch. A spring washer 24 fits over the shaft 16 and bears on the rear of the rotor to urge the face 22 of the rotor into engagement with a matching face of cover 20. Since the rotor 14 and cover 20 are metallic, electrical continuity is ensured thereby.

Two generally U-shaped channels 50 are disposed in the rotor 14 to form the outer walls of two transmission line segments whose ends 28 terminate at the planar face 22 in a geometrically square configuration so that such ends 28 will be aligned at the same locations when the rotor 14 is rotated 90 degrees. Center conductors 30 are disposed within the channels 50 in a dielectric medium such as polyethylene or other plastic along the center axes of the channels 50. These channels are of uniform diameter so that a uniform characteristic impedance is maintained over the length of the transmission line segments. One method of forming the U-shaped transmission line segments in the rotor 14 is to fabricate the rotor using two discs into which the channels are machined; the discs are then assembled along with center conductors and appropriate dielectric material to provide a unitary rotor structure.

The cover 20 has four bores 32 extending therethrough substantially parallel to the switch axis and in alignment with the four transmission line ends 28 of the rotor. One end of each of such bores 32 is enlarged and threaded to accept the metallic connector 36 of a coaxial cable 34. A short transmission line segment is formed in each bore 32 between the coaxial connector 36 and the rotor face. The diameters of these bores and the diameters of the channels 50 in the rotor are equal so that a uniform diameter of the walls of the transmission line segments is provided. Further, these diameters are equal to the inside diameter of the outer conductors of the coaxial cables 34 so that the uniform diameter extends to the coaxial cables as well as the transmission line segments through the switch. The spring-loaded contact assemblies each comprising spring 38, contact 40, and dielectric wafer 42 are assembled within the bores 32 to provide electrical contact between center conductors 44 and 30. The dielectric wafers 42 suitably may be of plastic to match the dielectric constant of the dielectric medium within the channels 50. Air is utilized as a dielectric over the transmission line segments between wafers 42 and connectors 36; however, because the contact diameter is larger than the center conductor diameter the impedance provided thereby is the same as that in the segments utilizing dielectric material. The abrupt changes in dielectric constants have a minimum effect on the operational characteristics of the transmission line portions through the switch since such discontinuities are normal to the center conductors of the transmission lines. Thus a constant impedance characteristic is apparent over the entire length of the transmission lines.

The double pole, double throw action of the switch is provided by rotating the switch 90 degrees. Non-conducting paths 46 are provided on the rotor face 22 between transmission line ends 28 so that the spring-loaded contacts 40 are insulated during rotation of the switch. These paths may be provided by depositing a non-conducting material on the face 22 or by milling a shallow channel and filling it with an insulating material such as plastic.

Similarly, non-conducting paths 52 may be provided on the rotor face 22 to provide information regarding the switch position. A spring-loaded electric contact may be provided in the cover 20 which will sense ground potential in one switch position, and an open in the alternate switch position. This information may be utilized to provide notification of the switch position to a computer or microprocessor, for example. Additionally, this scheme may be extended by utilizing a number of non-conducting dots at each switch position to establish a code to be read by a plurality of spring-loaded contacts in the cover. By decoding which contacts are open and which are grounded, an ASCII code can be established to provide an indication of the switch position. This application is particularly useful when used in conjunction with the multiple-position switch to be described next.

Figure 4:
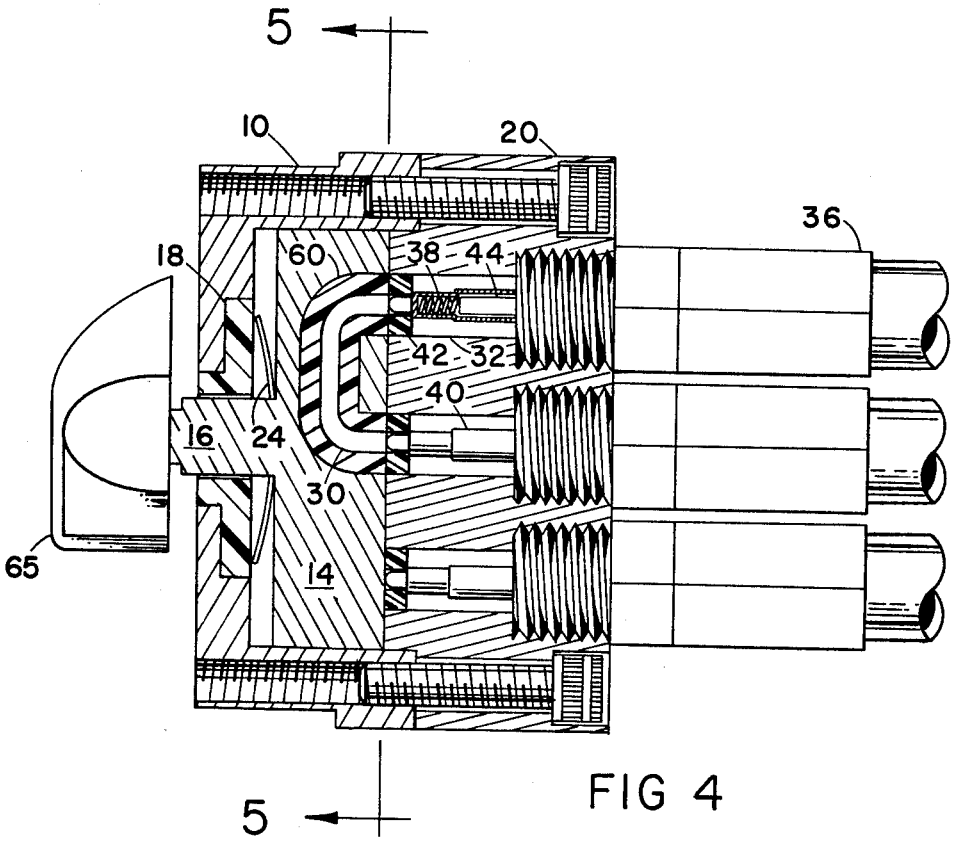
FIG. 4 is an elevational cross-sectional view of a single pole, multiple throw configuration of the coaxial switch.
Figure 5:
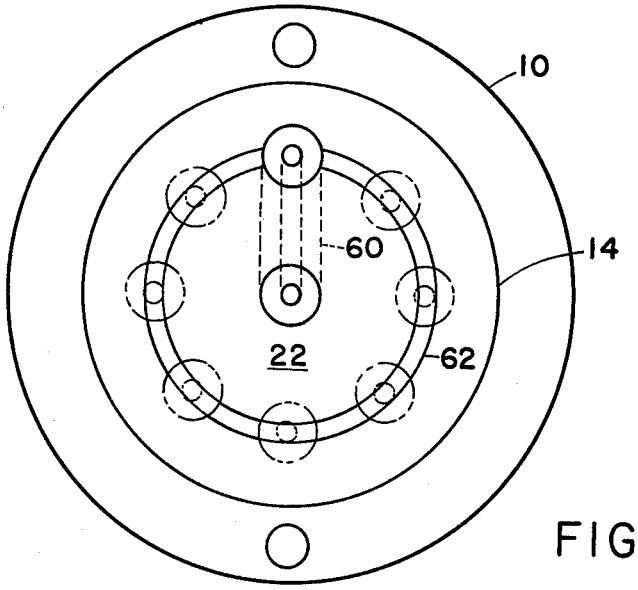
FIG. 5 is a cross-sectional view taken along the lines 5—5 of FIG. 4.

A single pole, multiple throw switch structure is shown in FIGS. 4 and 5. Generally, the same principles applying to the double-pole, double-throw switch described previously regarding the general switch structure and constant impedance characteristics apply to this switch as well. In this configuration a single U-shaped channel 60 is disposed in rotor 14 and is provided with a center conductor 30 suspended at the central axis thereof in a dielectric medium to provide a single U-shaped transmission line segment having one end thereof terminating on the rotor face 22 at the center axis of the switch so that this end remains stationary as the rotor 14 is rotated. The other end of the U-shaped transmission line segment is offset from the center axis of the switch and thus is free to describe an arc thereabout as the rotor 14 is rotated. The cover 20 includes a plurality of bores 32 containing spring-loaded contact assemblies circumferentially disposed about the aforementioned arc to provide a plurality of switch positions. These positions are shown in phantom in FIG. 5. A circular insulative path 62 may be provided about the arc to insulate the spring-loaded contacts in the unused switch positions.

While the single pole, multiple throw switch may be operated by motorized mechanism such as that described in connection with FIGS. 1–3, a knob 65 is shown for operation of the switch. Similarly, the knob may be utilized on the double pole, double throw version of the switch. In such a version, an indexing or detent mechanism may be provided to ensure proper rotor positioning.

It can therefore be appreciated that the coaxial switch herein described may be adapted to a number of operating configurations, and may be manually or electrically driven. Cross talk between center conductors is minimized because the metallic cover and rotor parts are contiguous with the channel walls which serve as the outer conductor of the transmission line portions. A uniform and predictable impedance characteristic is provided over the length of all transmission line portions of the switch.

While preferred embodiments of the present invention have been illustrated and described, it will be apparent that changes and modifications may be made to the invention without departing from its broadest aspects. The appended claims therefore cover all such changes and modifications that come therewithin.

I claim:

1. A coaxial switch, comprising:

a cylindrical housing having a socket therein and a metallic end wall portion thereof;

a metallic rotor mounted in said socket, said rotor and said end wall having matching planar faces transverse to the cylindrical axis of said switch;

at least one substantially U-shaped transmission line segment disposed in said rotor such that the ends of said transmission line segment terminate at the planar face of said rotor; and at least two transmission line segments disposed in said end wall such that an end of each segment terminates at the planar face of said end wall, said transmission line segments in said end wall being adapted for electrical engagement with said transmission line segment in said rotor to provide a continuous conductive path through said switch, wherein all of said transmission line segments comprise channels having a uniform diameter inner wall over the length of said segments, a center conductor disposed along the central axis of each channel, and a dielectric between said center conductor and said inner wall, said dielectric having a uniform radial dielectric constant.

2. A coaxial switch in accordance with claim 1 wherein said transmission line segments disposed in said end walls include spring-loaded contacts coupled to the center conductors thereof for electrical engagement with the center conductors in said rotor.

3. A coaxial switch in accordance with claim 2 wherein the planar face of said rotor includes a non-conductive path for insulating said spring-loaded contacts as said rotor is rotated between switch positions.

4. A coaxial switch in accordance with claim 1 further including means for providing an indication of switch positions selected.

* * * * *